US007776812B2

(12) United States Patent
Lang et al.

(10) Patent No.: US 7,776,812 B2
(45) Date of Patent: Aug. 17, 2010

(54) MULTIPLE EMULSION HARD SURFACE CLEANING COMPOSITIONS

(75) Inventors: Angus Lang, Paris (FR); Malcolm Tom McKechnie, Driffield (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 607 days.

(21) Appl. No.: 10/552,573

(22) PCT Filed: Apr. 16, 2004

(86) PCT No.: PCT/GB2004/001672

§ 371 (c)(1),
(2), (4) Date: Nov. 15, 2006

(87) PCT Pub. No.: WO2004/094582

PCT Pub. Date: Nov. 4, 2004

(65) Prior Publication Data

US 2007/0111917 A1 May 17, 2007

(30) Foreign Application Priority Data

Apr. 16, 2003 (GB) ..... 0308743.4

(51) Int. Cl.
*C11D 3/44* (2006.01)
*C11D 7/14* (2006.01)

(52) U.S. Cl. ..... 510/417; 510/191; 510/238; 510/242; 510/418; 510/432; 510/438; 510/460; 510/486

(58) Field of Classification Search ..... 510/191, 510/238, 242, 417, 418, 432, 438, 460, 486
See application file for complete search history.

(56) References Cited

U.S. PATENT DOCUMENTS

| | | | | |
|---|---|---|---|---|
| 3,917,859 | A | 11/1975 | Terada et al. | |
| 4,810,407 | A * | 3/1989 | Sandvick | 510/400 |
| 5,942,216 | A * | 8/1999 | Herb et al. | 424/70.28 |
| 5,948,855 | A * | 9/1999 | Lin et al. | 524/837 |
| 5,985,177 | A * | 11/1999 | Yoshida et al. | 516/113 |
| 6,022,547 | A * | 2/2000 | Herb et al. | 424/401 |
| 6,171,600 | B1 | 1/2001 | Dahms | |
| 6,235,298 | B1 * | 5/2001 | Naser et al. | 424/401 |
| 6,268,322 | B1 * | 7/2001 | St. Lewis et al. | 510/130 |
| 6,270,878 | B1 * | 8/2001 | Wegele et al. | 428/195.1 |
| 6,290,943 | B1 * | 9/2001 | Naser et al. | 424/70.15 |
| 6,306,806 | B1 | 10/2001 | St. Lewis et al. | |
| 6,358,500 | B1 * | 3/2002 | Simon | 424/70.12 |
| 6,410,038 | B1 * | 6/2002 | Lin et al. | 424/402 |
| 6,464,966 | B1 * | 10/2002 | Simon | 424/70.12 |
| 6,797,685 | B2 * | 9/2004 | Zhu et al. | 510/417 |
| 2002/0077372 | A1 * | 6/2002 | Gers-Barlag et al. | 516/98 |
| 2002/0127252 | A1 * | 9/2002 | Kramer et al. | 424/401 |
| 2003/0133957 | A1 * | 7/2003 | Amalric et al. | 424/401 |
| 2003/0149102 | A1 * | 8/2003 | Afriat et al. | 514/474 |
| 2003/0175317 | A1 * | 9/2003 | Barthel et al. | 424/401 |
| 2004/0063593 | A1 * | 4/2004 | Wu et al. | 510/130 |
| 2008/0268004 | A1 * | 10/2008 | Kim et al. | 424/401 |

FOREIGN PATENT DOCUMENTS

| | | | |
|---|---|---|---|
| EP | 0 717 978 | A | 6/1996 |
| EP | 0 782 846 | A | 7/1997 |
| EP | 1059378 | A1 | 12/2000 |
| EP | 1090981 | A1 | 4/2001 |
| WO | WO 97/17938 | A1 | 5/1997 |
| WO | WO 01/28502 | A1 | 4/2001 |
| WO | WO 01/30308 | A | 5/2001 |
| WO | PCT/GB01/03136 | | 1/2002 |
| WO | WO 02/069917 | A | 9/2002 |

OTHER PUBLICATIONS

International Search Report dated Jul. 1, 2004 for application PCT/GB2004/001672.
Combined Search and Examination Report from The Patent Office in Great Britain dated Sep. 4, 2003 for application GB 0308743.4.
International Preliminary Report on Patentability dated Apr. 25, 2005 for application PCT/GB2004/001672.
Written Opinion of the International Searching Authority for application PCT/GB2004/001672.
Binks B.P. and Lumsdon S.O.: "Stability of oil-in-water emulsions stabilized by silica particles", Physical Chemistry Chemical Physics, vol. 1, 1999, pp. 3007-3016, XP002286721; cited in the application; p. 3007-p. 3016.

* cited by examiner

*Primary Examiner*—Charles I Boyer
(74) *Attorney, Agent, or Firm*—Norris McLaughlin & Marcus, PA

(57) ABSTRACT

The present invention provides a cleaning composition comprising a multiple emulsion system, wherein said emulsion system comprises at least two active ingredients separated in the emulsion system by an oily or aqueous phase. Also described is the use of such multiple emulsion systems as cleaning compositions, and a method of cleaning a surface using multiple emulsion systems.

17 Claims, 3 Drawing Sheets

MULTIPLE EMULSION HARD SURFACE CLEANING COMPOSITIONS

The present invention relates to multiple emulsion cleaning compositions, to their manufacture, and uses, and methods of cleaning using such compositions, for example for cleaning hard and/or fabric surfaces.

Multiple emulsions are complex systems and can be thought of as "emulsions of emulsions". In other words, within a multiple emulsion, the globules of the dispersed phase contain even smaller dispersed droplets themselves.

Essentially, there are two major types of multiple, or double emulsions; water-in-oil-in-water (w/o/w) and oil-in-water-in-oil (o/w/o) emulsions.

Multiple or double emulsions were first described in *J. Phys. Chem* (1925) 29, 738 and subsequently, it has been appreciated that multiple emulsions have the potential to be useful in many applications since they can effectively serve as an entrapping reservoir for active ingredients which can be released from the inner phase to the outer phase by a controlled and sustained mechanism, see *Colloids Surf. A*., (1997) 23-24, 233. Alternatively, active substances may migrate from the outer to the inner phase. In this latter case, the system provides a kind of sorbent reservoir which would be particularly suitable in certain applications, for example in detoxification or in the removal of toxic materials from, for instance, waste water.

U.S. Pat. No. 3917859 (Terada et al) and, for instance, *J. Pharm. Sci*., (1879) 67, 63 disclose the use of multiple emulsions in the areas of food, cosmetics, medicine and pharmaceuticals. Moreover, multiple emulsions show much promise in non-pharmaceutical areas requiring the slow and controlled release of materials, for instance the release of fertilisers and pesticides in agricultural uses.

Multiple emulsions of the (o/w/o) type are found to be useful for protecting the skin from dryness due to an occlusion effect of the continuous oil phase. Moreover, (o/w/o) emulsions can prolong the active life of, and/or stabilise lipophilic agents, by enclosing them in the innermost oil phase. Moreover, such lipophilic agents can rapidly permeate through the skin and are essential to keep skin healthy, see *Journal of Surfactants and Detergents*, (1999) 2, 309.

It has now been found that the properties of multiple emulsions are particularly suited to the preparation of cleaning compositions, particularly household and non-cosmetic cleaning compositions, wherein it is often desirable that the active ingredients therein are kept apart, for instance, as and until the mixing of the active ingredients is required, since in multiple emulsions the drops of the dispersed phase themselves contain smaller droplets that are miscible with the external continuous phase. Thus, in multiple emulsions of the (w/o/w) type, the internal and external aqueous phases are separated by an oily phase, and in emulsions of the (o/w/o) type, the aqueous phase is surrounded by two, separated oily phases. Such effective separation of active ingredients via separated phases is not readily achieved in conventional cleaning compositions which are not of the multiple emulsion type, or even those of the multiple emulsion type stabilised by conventional surfactant technology. In effect, two mutually incompatible or antagonistic ingredients can be made available within the same cleaning composition, one held in the inner phase of the multiple emulsion system, the other in the outer phase. As such, the ingredient in the inner phase will be effectively protected from the ingredient in the outer phase. Moreover, in view of the fact that classical surfactants may pose consumer compliance problems, for example, causing irritation or de-greasing of the user's skin, a composition which avoids the need for classical surfactants is desirable.

Thus, in accordance with a first aspect of the present invention, there is provided a cleaning composition comprising a multiple emulsion system, wherein said emulsion system comprises at least two active ingredients separated in the emulsion system by an oily or an aqueous phase.

Preferably, the emulsion system comprises two to four active ingredients, more preferably two or three active ingredients, most preferably three active ingredients.

Preferably, when said multiple emulsion system is in use as a cleaning composition, then the at least two active ingredients previously held separate in the system are brought into contact with each other.

By "separated", we mean held in the outer and inner aqueous phases of a (w/o/w) emulsion or the inner and outer oily phases of a (o/w/o) emulsion. For instance, if two active ingredients are to be kept separate, one is held in the outer phase, the other in the inner phase. In a (w/o/w) emulsion, the active ingredients will be separated by the oily phase; in a (o/w/o) emulsion, the active ingredients will be separated by an aqueous phase. If, however, three of the active ingredients are to be kept separate, or more precisely, one is to be kept separate from two others (which two others do not need to be kept separate), then the one to be kept separate can be kept in the inner phase, the other two in the outer phase, or vice versa. If four active ingredients are present, two can be in each of the inner and outer phases, or the one to be kept separate from the others can be kept in the inner phase, the others in the outer phase, or vice versa.

By "oil" or "oily phase" we mean any material which is or can be kept separate from an adjoining water phase. We mean to include within the ambit of the term "oil" or "oily phase" all materials which may be designed as such in the context of emulsion systems. Typical examples include silicone oils, paraffin oils, triglycerides, fatty alcohols and ester oils. Paraffin oils are especially preferred.

In accordance with the present invention said active ingredients are preferably components which are additional to the w/o components which are the fundamental w/o elements of the multiple emulsion.

The term "cleaning" as used herein may include: removal of 30 soil deposits; de-scaling; prevention of soiling or scaling; bleaching; combating of microbes, or residues therefrom, including by one or more of antiseptic, disinfectant, bactericidal and anti-allergenic action, surface coating and/or modification; depilation/epilation;

and preventative cleaning ("keep-clean"). Preferably "cleaning" herein includes the prevention, removal and/or masking of stains and/or marks on surfaces.

Suitably, the cleaning compositions of the present invention are useful for non-cosmetic cleaning duties, particularly for household cleaning duties, and thus will preferably comprise active ingredients useful in the area of such duties.

Multiple emulsions can be viewed as systems that control the transport of chemical moieties, for instance, active ingredients, from an external to an internal phase, or vice versa. In effect, the oily phase between two aqueous phases in a (w/o/w) multiple emulsion, or the aqueous phase between two oily phases in a (o/w/o) multiple emulsion, allows for the incorporation of a high level of normally incompatible or mutually antagonistic substances within the two aqueous phases, or two oily phases, respectively. As such, the use of multiple emulsions as cleaning compositions will allow two, possibly mutually incompatible or antagonistic, substances to be present in the same cleaning composition, one substance in the inner phase and the other in the outer phase, and separated by the oily or aqueous intermediate phase, depending on the particular multiple emulsion system chosen. Moreover, the use of multiple emulsions will allow for the complete protection of the encapsulated substance in the inner phase from the effects of the substance in the outer phase, and vice versa. As such, the use of multiple emulsions will allow normally incompatible or mutually antagonistic substances to be present in a homogenous (i.e. a single pack) formulation, and will therefore remove the need for dual chamber packaging, and the like, in such circumstances.

The multiple emulsion is suitably of the oil-in-water-in-oil type (o/w/o) type or of the water-in-oil-in-water type (w/o/w). Preferably the multiple emulsion is of the (w/o/w) type.

Of course the aforementioned "at least two active ingredients" are separate for a useful "shelf-life" period. Thus the emulsion system is effectively stabilised. By "effectively stabilised", we mean that macroscopically there is no or only nominal mixing of the is phases of the multiple emulsion system, for example visible mixing, when assessed over some convenient time, for example after standing for three months at 25° C.

Suitably, the multiple emulsion system is stabilised such that the active ingredients in the two aqueous phases (in the case of a (w/o/w) emulsion) or the two oily phases (in the case of a (o/w/o) emulsion) are effectively kept apart and, preferably, only brought into contact with each other when the cleaning composition is in use, for example by some external or internal trigger which causes the two aqueous phases or two oily phases, respectively, to mix.

Thus, preferably, the multiple emulsion system is stabilised to the extent that the active ingredients are separated for the shelf-life of the cleaning composition, more preferably for in excess of the shelf-life, and at least until the trigger is activated.

More preferably, the multiple emulsion system is stabilised by a particulate moiety, suitably a particulate moiety capable of exhibiting more than one degree of hydrophobicity. An example of a suitable particulate moiety for use in the multiple emulsion systems of the present invention is a finely divided solid particulate, such as fumed or functionalised silica. Other examples that are suitable include superfine waxes, such as paraffin waxes, organic stabilisers, such as organic polymeric materials, clays, functionalised titanium, or indeed, any nanoparticle capable of sufficiently stabilising the multiple emulsion system. However, functionalised silica is preferred.

The term "fumed silica" is herein used to represent completely silylated silica. By "functionalised silica", we mean silica in which a certain proportion of the silanol moieties of fumed silica have been replaced by another chemical functionality. A particular example is replacement of —OH moieties by —$OSi(Me)_2Cl$ moieties.

The use of finely divided solid particles in stabilising simple emulsions, i.e. emulsions having only two phases, has been known for some time. It has previously been disclosed that functionalised silica particles of 20 nm diameter can be used as emulsion stabilisers for oil and water media, see for example, *Phys. Chem. Chem. Phys.*, (1999) 1, 3007. Moreover, it has been found that other small solid particles can be used in place of traditional surfactants as stabilisers of simple (o/w) and (w/o) emulsions, such as clay particles, see *Phys. Chem. Chem. Phys.*, (2000) 2, 5640, and monodisperse spherical polystyrene latex particles, see *Langmuir*, (2001) 17, 4540. It has now been found that by using particulates as stabilisers in the multiple emulsion systems, there is a much more distinct boundary formed between the oil and water phases of (w/o/w) and (o/w/o) multiple emulsion systems, than in simple emulsion systems or even in surfactant, rather than particulate, stabilised multiple emulsion systems, see *Proc. 3rd World Congress on Emulsions, Binks* et al, (2002). Indeed, using particulates in this manner shows marked benefits in phase separation compared to the conventional method of using surfactants as phase separators.

Without wishing to be bound by theory, it is believed that the particulates improve the stability of the multiple emulsion systems because the energy of stabilisation at the o/w interface is much greater than with the corresponding surfactant system. For instance, whereas a comparable multiple emulsion system using mixed surfactants as stabilisers, using, for example, non-ionic lipophilic and hydrophilic emulsifiers, would easily coalesce if shaken, use of particulate particles, such as functionalised silica particles, will improve the stability of the separation of active and/or antagonistic ingredients in the multiple emulsion by forming and maintaining more distinct boundaries in the multiple emulsion system. Moreover, a surfactant stabilised multiple emulsion system if it is to be effective must not allow the contents of the separated aqueous or oily phases to 'leak' across the oil or aqueous phase boundary respectively, leading to a premature breakdown and failure of the emulsion. Indeed, it is found that using functionalised silica as a multiple emulsion stabiliser will lead to the formation of stable emulsions, with little or no coalescence of the phases upon shaking. Further, it has now been found that by using two types of silica particles, preferably both of less than 50 nm in diameter, e.g. silica particles with different levels of hydrophilicity/hydrophobicity, it is possible to prepare stable (w/o/w) and (o/w/o) multiple emulsion systems.

Moreover, using particulate stabilised multiple emulsion systems as cleaning compositions will enable compositions containing no surfactants to be used. By avoiding the use of surfactants, the cleaning compositions described herein will exhibit improved consumer benefits/compliance as the irritant and de-greasing effects of surfactants will be avoided or at least alleviated.

Without wishing to be bound by theory, it is believed that the "wettability" of the particulate moiety will determine the type and stability of the emulsion thus formed. Moreover, the "wettability" of the moiety is determined by the hydrophobicity of the particulate moiety. Therefore, by using two moieties of different levels of hydrophobicities it is possible to form stable multiple emulsion systems.

Suitably, the particulate moieties will be less than 50 nm in mean diameter, preferably less than 30 nm in mean diameter, for example about 20 nm in mean diameter (in each case as measured by the standard test method, DIN4188). Preferably, the particulate moiety in each case will be silica, more preferably functionalised, or fumed, silica.

Suitably when more than one particulate moiety is present, each particulate moiety will differ from each other in terms of hydrophobicity. Preferably, there will be two particulate moieties present, one hydrophobic and the other hydrophilic. More preferably, the two particulate moieties will be two different forms of functionalised, or fumed, silica, each with a different level of hydrophobicity, and dependent upon the nature of the functionalisation.

Particles of the hydrophilic type will prefer to stabilise (o/w) emulsions, whilst particles of the hydrophobic type will prefer to stabilise (w/o) emulsions. Without wishing to be bound by theory, the variation in hydrophobicity of the particles is thought to lead to a change in contact angle of the particles with the oil-to-water interface, which has consequences on the preferred curvature of this interface. Fumed silica (i.e. $SiO_2$ derivatised 100% with silanol (SiOH) groups is hydrophilic. On the other hand, reacting fumed silica with dichlorodimethylsilane will result in certain of the silanol groups on the surface of the silica being replaced by $Cl(Me)_2SiO$— groups, with a corresponding increase in the hydrophobicity of the functionalised silica thus formed. This is shown in FIG. 1 of the accompanying drawings.

Indeed, the percentage of residual silanol (SiOH) groups remaining on the surface of the silica can be used as a quantitative measure of particle hydrophobicity.

Suitably, the more hydrophobic particulate moiety will be functionalised silica in which the percentage of silanol groups/groups in total is 65% or less, preferably 60% or less, more preferably 55% or less, for example 50 to 51%.

Suitably, the more hydrophilic particulate moiety will be functionalised silica in which the percentage of silanol groups/groups in total is more than 65%, preferably 70% or more, more preferably 76% or more, for example 76 to 80%.

Suitably, multiple emulsions of the (w/o/w) and (o/w/o) types, containing particulate material, are prepared as follows. First, a simple (w/o) or (o/w) emulsion is prepared. For example, adding a small amount of pure water to a larger amount of oil containing an amount of a hydrophobic particulate material, will produce a simple (w/o) emulsion. On the other hand, adding a small amount of oil to a larger amount of pure water containing an amount of a hydrophilic particulate material will produce a simple (o/w) emulsion.

The (w/o) simple emulsion produced as described above is homogenised and then re-emulsified in an amount of aqueous phase containing an amount of a hydrophilic particulate material, wherein the amount of aqueous phase in this step is broadly similar to the amount of oil used in the preparation of the simple (w/o) emulsion, thus forming a (w/o/w) multiple emulsion system.

Alternatively, the (o/w) simple emulsion produced as described above is homogenised and then re-emulsified into a further oil phase in an amount broadly similar to the amount of water used in the preparation of the (o/w) emulsion. The further oil phase contains an amount of a hydrophobic particulate material. Thus, a (o/w/o) multiple emulsion system will be formed.

Multiple emulsion systems of the present invention may be stabilised by surfactants, as described, for example in Surfactant Science and Technology, $2^{nd}$ edition, Drew Meyers, 1992, VCH Publishers Inc. The surfactant requirements are such that two stabilising systems must be employed: one for each oil-water interface. As noted above they should not interfere with each other.

A general procedure for the preparation of a w/o/w multiple emulsion may involve the formation of a primary emulsion of water in oil using a surfactant suitable for the stabilisation of such w/o systems. Generally, that will involve the use of an oil-soluble surfactant with a low HLB (preferably 2-8). The primary emulsion will then be emulsified in a second aqueous solution containing a second, water-soluble, surfactant system (HLB preferably 6-16).appropriate for the stabilization of the secondary o/w emulsion A general procedure for the preparation of an o/w/o multiple emulsion may involve the formation of a primary emulsion of oil in water using a surfactant suitable for the stabilisation of such o/w systems. Generally, that will involve the use of a water-soluble surfactant with a high HLB (preferably 6-16). The primary emulsion will then be emulsified in a second oil phase containing a second, oil-soluble, surfactant system (HLB preferably 2-8) appropriate for the stabilization of the secondary w/o emulsion In a w/o/w emulsion the external aqueous phase w may be a gel phase. A gelling agent may be employed, for example a natural gum such as locust beam gun or carrageenan, or a synthetic gelling agent such as a salt of a polyacrylic acid, or a cellulosic compound.

Although multiple emulsions stabilised only by surfactants may be made in accordance with the present invention, multiple emulsions stabilised at least in part (and preferably wholly by) particulate moieties are especially favoured in the practice of this invention.

Stable multiple emulsion systems allow for the effective separation of two or more mutually incompatible active or antagonistic ingredients in a homogenous formulation. Thus, within the preferred (w/o/w) emulsions of the present invention, it would be possible to separate two mutually incompatible active, water-soluble ingredients within a homogeneous formulation. This is shown schematically in FIG. 2 of the accompanying drawings, in which region (1) is the inner region of water containing a first active ingredient, region (2) is the oil phase, and region (3) is the outer region of water containing a second active ingredient.

Suitably, the ratio of water containing a first active ingredient to the oil phase to the water containing a second active ingredient, i.e. the ratio of the volume of region (1) to the volume of region (2) to the volume of region (3), is between 1:2:10 and 1:6:30, preferably between 1:3:15 and 1:5:25, for example about 1:4:20. These ratios are given on a volume basis. Similar ratios are suitable for (o/w/o) multiple emulsions, with the ratio in this case being the oil containing a first active ingredient to the water phase to the oil containing a second active ingredient, once again on a volume basis.

Suitably, the multiple emulsion systems of the (w/o/w) type consist of inner w/o droplets of 0.1-5 μm in diameter, preferably 0.3-4 μm in diameter, most preferably 0.5-2 μm in diameter, and outer o/w droplets of 5-100 μm in diameter, preferably 7-80 μm in diameter, most preferably 10-60 μm in diameter. The preferred sizes are also applicable to multiple emulsion systems of the (o/w/o) type, for the inner o/w and outer w/o droplets, respectively.

Preferably, the active ingredients which are separated in the multiple emulsion system are brought into contact with each other when the cleaning composition is in use, such contact conveniently being brought about by some form of external or internal trigger, rather than by leakage/seepage or dilution caused by an ineffective stabilisation of the multiple emulsion system.

For example, the active ingredients could be brought into contact by shearing the emulsion. In the case of cleaning compositions, it could be envisaged that such shearing forces could be applied either as a result of the application of the cleaning composition to the surface to be cleaned, i.e. the shear forces involved in the application process involving spraying, squirting, and the like, or the shear forces encountered when the composition has been applied and is then wiped on the surface by the user. Alternatively, but equally applicably, the active ingredients could be brought into contact by the application of pressure. In the case of cleaning compositions, it is most likely that the pressure will be applied by the user of the cleaning composition in the use thereof, for example by smearing, wiping, rubbing, etc. the composition after application, and this process can also involve the shearing forces discussed previously.

Further alternatives for bringing the active ingredients into contact include adjusting the temperature of the composition, evaporation of the separating phase, demulsification using suitable demulsifying agents which act by disrupting the stability of the interface, (see, Modern Aspects of Emulsion Science, ed. Binks B. P., Royal Society of Chemistry, ISBN 0-85404-439-6, (1998), which discusses in general the stability of, and how to destabilise, emulsions, the contents of which is herein incorporated by reference) and dilution of the multiple emulsion under hypo-osmotic conditions.

In the case of the latter of these possibilities, i.e. dilution under hypo-osmotic conditions, the concentration of the dissolved species forming the active ingredients is such that a concentration gradient is established between the species, leading to a net flow of water from the external phase to the internal phase. Thus, in the preferred case of a (w/o/w) multiple emulsion system, there will be a flow of water from the external aqueous phase to the internal aqueous phase across the separating oily phase. This flow will lead to an increase in the droplet size within the internal aqueous phase. The oily phase droplets will also swell in size as a direct result of the increase in droplet size in the internal aqueous phase. When the oily phase droplets reach a critical size the oily droplets will burst as the oil membrane breaks down, thus releasing into the external aqueous phase the active ingredient previously encapsulated in the internal aqueous phase.

The transport mechanism under hypo-osmotic conditions for a (w/o/w) multiple emulsion is shown schematically in FIG. 3 of the accompanying drawings.

Yet still further possibilities for bringing the active ingredients into contact with each other include the breakdown of the multiple emulsion system by photodegradation, temperature activated degradation (either by decreasing or, preferably, increasing the temperature to a certain level at which degradation of the 15 emulsion system takes place), and the addition of a further species, for instance via a wipe, which causes degradation of the emulsion system. In the latter case, the species is suitably a chemical species, preferably an electrolyte (e.g. saline), or a catalyst for the degradation process.

Nevertheless, although it is possible for the active ingredients in the multiple emulsion system to be brought into contact with each other by a trigger and thus be used as a cleaning composition post-trigger, it is also possible that the active ingredients can each, both or all function as cleaning aids whilst the integrity of the multiple emulsion is intact, i.e. pre-trigger. Thus, in its broadest sense, the present invention simply concerns a stabilised multiple emulsion system wherein cleaning composition active ingredients can be held in separate phases. Each of these ingredients can function as a cleaning agent pre-trigger when the multiple emulsion remains intact, and/or may function post-trigger, after the emulsion has collapsed. In the latter case, the active ingredients will be brought together and therefore the ingredients may act independently of each other, the purpose of the multiple emulsion simply being to keep the ingredients apart as and until desired, or may act synergistically, or may react to form different or enhanced active ingredients for use in cleaning compositions. Thus, the breakdown or rupture of the lo multiple emulsion system can have the effect of simply bringing two active ingredients together, forming a new active ingredient, enhancing the ability/performance of the original active ingredient(s), releasing a cleaning agent pre-formed in one phase into contact with the active ingredient from a further phase, and/or forming a cleaning agent in situ from precursors originally held in separate phases.

By "active ingredients" it is meant moieties held within the multiple emulsions that can have some effect, preferably a positive effect, on the performance of the multiple emulsion system as a cleaning composition, preferably by enhancing the efficiency, and/or speed of action of the cleaning composition, and/or ease of use, preferably but not necessarily solely, as and when the multiple emulsion breaks down and the active ingredients are brought into contact with each other. Alternatively, at least one of the active ingredients may simply provide an indication that the multiple emulsion has collapsed and the initially separated phases have mixed, without itself having a direct effect on the cleaning action of the composition. Alternatively or additionally, the active ingredients can each provide a positive cleaning effect alone, thus providing a cleaning composition of dual functionality, and furthermore any cleaning effect can occur either pre-trigger, when the multiple emulsion remains intact, or post-trigger, after collapse of the emulsion. It is therefore possible that even after the multiple emulsion breaks down, the active ingredients will mix but each may still have the cleaning effect expected as if the active ingredient was the only one present. In effect, the multiple emulsion system is simply keeping the, possibly reactive and/or antagonistic, active ingredients apart. As such, the multiple emulsion system can therefore provide a sequential cleaning action where first one active ingredient and then the other act one after the other, rather than simultaneously, after the multiple emulsion breaks down.

Also included within the term "active ingredients" are moieties which it is preferable to keep apart as and until the external or internal trigger causes the moieties to come into contact. Therefore, the term "active ingredients" can also encompass moieties which would generally be regarded to be antagonistic towards each other and which, under normal direct contact, would react in a manner detrimental to at least one of the active ingredients before such a reaction was required. Hence, were such active antagonistic ingredients not kept apart as in the multiple emulsion system, the shelf-life of the cleaning composition would simply be determined by the rate at which the antagonistic ingredients react, rather than the stability of the multiple emulsion system keeping the active ingredients apart.

Thus, whereas the present invention in its broadest sense is directed towards cleaning compositions comprising a multiple emulsion system comprising at least two active ingredients effectively separated by use of stabiliser(s), particularly particulate stabiliser(s), which stabilise(s) the system to the extent of effectively keeping the phases apart, the following are more particular examples of suitable active ingredients which can be encapsulated by the inner and outer phases of the emulsion system and which are thus separated in the emulsion system.

Suitably, either or preferably both active ingredients could comprise a colour molecule or dye. Therefore, when in use, i.e. when the phases have mixed after the external or internal trigger, the colour molecules forming the active ingredients will mix and the resultant colour change of the cleaning composition will signal that the two phases have mixed. The colour change could therefore be used as an indication that the regions containing the active ingredients have mixed and thus, were these regions to also contain molecules which, when in direct contact, caused or enhanced the cleaning properties of the cleaning composition, the colour change would indicate that the cleaning properties had begun or were being enhanced. Suitably, the phases of the multiple emulsion could additionally comprise active ingredients which function as cleaning aids or agents even before the emulsion collapses.

Alternatively, the same effect could be achieved were one of the active ingredients to be a bleach, the other a colour molecule or dye. Once again, the resulting colour change as the dye and bleach are brought into contact could be used as a visual sign that the originally-separated regions are now in contact such that cleaning or enhancing cleaning properties are in effect. In essence, the mixing of the colour and the bleach will provide the user of the composition with a sensorial cue that the multiple emulsion has broken down.

In either of the embodiments utilising a colour molecule or dye, the said colour molecule or dye is preferably selected from the group comprising indigo carmine, tartrazine or FD&C blue No. 1. In general, the colour molecules or dyes are disclosed in the Sigma Aldrich Handbook of Stains, Dyes and Indicators by Floyd J Green, ISBN 0941-633-225, (1990), the contents of which are herein incorporated by reference.

In a further specific embodiment of the invention, one active ingredient is an oxidising agent, the other a reducing agent. Either or both agents could function as cleaning agents in their own right, i.e. function before the emulsion collapses. Nevertheless, in this particular embodiment, mixing of the aqueous phases (for a (w/o/w) multiple emulsion) or the oily phases (for a (o/w/o) multiple emulsion), following the trigger, will result in a redox reaction, with consequent heat generation. The production of heat in this manner is particularly advantageous in cleaning compositions as heat will tend to speed up the cleaning process, thus providing a faster acting, easier to use, and more useful cleaning product with an improved cleaning performance than those without the redox/multiple emulsion technology described herein.

Generally, the more heat produced by the redox reaction, the greater the increase in temperature of the multiple emulsion system and hence the greater the potential increase in the speed of the cleaning process using the composition. Nevertheless, whilst the generation of heat in situ is a very attractive proposition for cleaning formulae and compositions for use on both hard and on fabric surfaces, there is clearly an upper temperature limit, above which the user of the composition would be placed at risk of injury/burns. Therefore, preferably, the temperature of the cleaning compositions of this embodiment in use will be above ambient temperature but below a temperature likely to cause injury/burns to the user of the composition, preferably between 30° C. and 50° C., more preferably between 35° C. and 45° C., for example about 40° C.

Examples of suitable oxidising agents for use in this particular embodiment include sodium chlorite and sodium perborate. Examples of suitable reducing agents for use in this particular embodiment include potassium iodide, sodium sulphite and ferrous ammonium sulphate. Preferably, the oxidising agent (or agents) is/are dissolved or dispersed together with an alkaline component (or components) and the reducing agent (or agents) is/are dissolved or dispersed together with an acidic component (or components) within the multiple emulsion system or vice versa.

In the specific embodiment where one active ingredient is an oxidising agent, the other a reducing agent, the mixing of the initially separated phases can lead to the initiation of a clock chemistry reaction. During such reactions, the pH of the reaction medium will oscillate between acidic and alkaline conditions. For instance, the two active ingredients which will indicate the clock chemistry reaction are each held in the two separate aqueous phases (in the case of a (w/o/w) multiple emulsion), or the two separate oily phases (in the case of a (o/w/o) multiple emulsion). In this embodiment, the cleaning action can be based on the pH oscillation of the clock chemistry reaction system.

In cleaning compositions, acidic conditions assist in the breaking down of alkaline-based moieties, for example limescale and the like, whilst alkaline conditions will assist in the breaking down of acidic-based moieties, for example in the breaking down of grease and proteinaceous deposits and the like. Hence, the initiation of clock chemistry will be particularly advantageous as both types of moieties (acidic and alkaline) can be sequentially attacked by the same composition. Most preferably, the active ingredients can be such that the pH of the composition remains acidic at the end of the clock chemistry reaction. In this case, the composition will continue to assist in the breaking down of alkaline-based moieties, such as limescale, as and until the composition is removed.

Suitable systems for this embodiment of the present invention may include those described in the following references:

Design of pH-Regulated Oscillators, G. Rabai et al, Acc. Chem. Res. 1990, 23, 258-263.

A General Model for pH Oscillators, Y. Luo et al, J. Am. Chem. Soc., 1991, 113, 1518-1522.

Temperature compensation in the oscillatory hydrogen peroxide-thiosulfate-sulfite flow system, G. Rabai et al, Chem. Commun., 1999, 1965-1966.

Kinetic Role of $CO_2$ in the Oscillatory $H_2O_2$— $HSO_3^-$— $HCO_3^-$ Flow System—G. Rabai et al, J. Phys. Chem. A1999, 103, 7224-7229.

Chaotic pH oscillations in hydrogen peroxide-thiosulfate-sulfite flow system, G. Rabai et al, J. Phys. Chem. A1999, 103, 7268-7273.

International Patent Application No. PCT/GB01/03136 (Reckitt Benckiser (UK) Limited).

Thus, preferably the multiple emulsion contains components which function as a pH clock. The autocatalytic species for the reaction is $H^+$ (or, more rarely, $OH^-$) and clocks may occur when a solution of a weak acid is oxidised to provide a strong acid, so that $H^+$ increases with the extent of reaction.

The chemical composition of a typical pH clock will involve an oxidant and a reductant species. Typically, the reductant will be the salt of a weak acid and the corresponding oxidant will be a strong acid.

Many different species can be used as partners in these redox systems. In seeking appropriate species, a useful guide for the overall reaction stoichiometry is that the reducing agent should release more protons per electron than the oxidising agent consumes.

Within the existing literature, the following species can be identified and may be of use in cleaning compositions:

Potential Oxidant:

I peroxo-compounds (eg $BrO_3^-$, $IO_3^-$, $ClO_3^-$, $ClO_2^-$, $S_2O_8^{2-}$, $ClO_2$, $H_2O_2$)

II oxidising metal compounds stable in alkaline solutions (e.g. $[Fe(CN)_6]^{3-}$).

Potential Reductant:

I all oxyanions of sulfur that contain S-S bonds (e.g. $S_2O_3^{2-}$, $S_4O_6^{2-}$, $S_2O_4^{2-}$, $S_2O_6^{2-}$).

II reducing agents that are significantly more basic than their oxidised counterparts (e.g. $SO_3^{2-}$, $N_2H_5^+$).

A matrix of combinations from some of these species can be constructed:

| | Reductant | | | | | |
|---|---|---|---|---|---|---|
| oxidant | $S_2O_3^{2-}$ | $S_4O_6^{2-}$ | $S_2O_4^{2-}$ | $SO_3^{2-}$ | $S_2O_6^{2-}$ | $N_2H_5^+$ |
| $BrO_3^-$ | Yes | Yes | Yes | Fast rxn | Yes | Yes |
| $IO_3^-$ | No rxn | No rxn | Yes | Yes | Yes | Yes |
| $ClO_3^-$ | No rxn | Yes | No rxn | No rxn | Partial | No rxn |
| $ClO_2^-$ | Yes | Yes | Fast rxn | Fast rxn | Yes | Fast rxn |
| $S_2O_8^{2-}$ | Partial | Partial | Partial | Partial | Partial | Partial |

where "Yes" indicates established evidence for clock reaction behaviour, "No rxn" indicates no observed reaction under conditions investigated to date and "Partial" indicates observation of evidence of autocatalysis but not yet developed to clock reaction study.

The most widely studied and exploited clock reactions are those typified by the Landolt clock reaction. This is the iodate-reductant system, where the reductant typically is $HSO_3^-$ or $H_3AsO_3$. The reaction is autocatalytic in $I^-$ (depending on the second power of the iodide ion concentration) and is a clock reaction system even in buffered solution. In unbuffered solution, the reaction is also autocatalytic in $H^+$.

Beyond those combinations mentioned above, there are reports of clock-type reactions with associated pH changes involving the following reagents:

permanganate ion as oxidant with reductant being sulfite, nitrite, selenite, arsenite thiosulfate+iodide+$H_2O_2$.

The addition of a second reductant to a Landolt system ("mixed-Landolt system") produces a clock reaction system in which the pH swings from high to low at the end of an induction period, and then back to high pH on a longer timescale.

An example of a clock reaction system starting at low pH and changing to high pH at the end of the induction period involves the reduction of $H_2O_2$ by various multidentate complexes of Fe(II) or Co(II) ions.

In further embodiments of the present invention, enzymes can be one of the active ingredients in the multiple emulsion systems. In such embodiments, the other active ingredient could, for instance, be a catalyst. In this case, the trigger mechanism will lead to a mixing of the enzyme-containing and catalyst-containing phases, thus enabling the cleaning composition to exhibit an improved enzyme efficiency. It is well-known in the art of cleaning compositions that enzymes play an important role in the cleaning process of both hard and fabric surfaces. Hence, the enzyme could function to one level of cleaning efficiency pre-trigger, and then, post-trigger and after mixing with the catalyst, could function to a different, preferably enhanced, level of cleaning efficiency.

Alternatively one active ingredient could be an enzyme and the other active ingredient could be an agent that terminates enzyme action, for example by degrading it or switching off its action (by pH change, for example).

Alternatively, one active ingredient could be an enzyme, whilst the other active ingredient could be a bleach, in which case the effect of a mixing of the phases will be to cause a mixing of the enzyme and bleach, leading to a cleaning composition of dual functionality. Alternatively, but equally applicably, the cleaning composition could function with a sequential action, initially acting by enzyme action, then bleach action. This particular combination of active ingredients is very effective as a cleaning composition but in the absence of the present stabilised multiple emulsion system technology, the enzyme and bleach would tend to react in the formulation and therefore would not be stable in storage and the shelf-life of the product would be adversely affected.

A further, and similar, embodiment has an enzyme as one active ingredient, and a peroxide moiety as the other active ingredient. In normal circumstances, enzymes will not survive under peroxide conditions and therefore this embodiment will allow the production and storage of stable cleaning compositions comprising these two active ingredients.

Alternatively, one active ingredient is a bleach, the other a bleach activator. Hence, when the trigger mechanism is activated, the active ingredients will mix, the bleach will be activated, and the cleaning composition will begin to function or will function with an improved efficiency due to the presence of activated bleach. Improved bleaching efficiency, particularly at lower temperatures, is especially useful for laundry care products or for the bleaching of hard surfaces. Cleaning compositions wherein the bleach and bleach activator are kept apart until the trigger will be stabilised for longer than in conventional formulations, leading to an increased shelf-life.

A preferred bleach in this embodiment is hydrogen peroxide, although percarbonates and perborates can also be used. Moreover, it is possible to use bleach precursors which can be activated with a catalyst to breakdown to give a bleach. In this case, preferred bleach activators are TAED and/or SNOBS which react to produce an active oxygen species with, for example, percarbonates and perborates. Alternatively, a bleach precursor, such as sodium chlorite can be reacted with an acid function to generate chlorine dioxide as a bleaching agent.

Preferably, when one active ingredient in one phase is an enzyme, for example proteases, lipases, amylases, cellulases and the like and a further active ingredient in a separate phase is bleach, the multiple emulsion system is of the (w/o/w) type and the active ingredients are in the aqueous phases. More preferably, the bleach is in the inner aqueous phase, whilst the enzyme is in the outer aqueous phase. Even more preferably, a fragrance/malodour combatting moiety is in the oily phase, and the multiple emulsion system is stabilised, preferably by functionalised silica. In this preferred embodiment, the fragrance is kept apart from the bleach.

Indeed, it is suitably found that the third phase of a three-component multiple emulsion, i.e. the oil phase of a (w/o/w) multiple emulsion, or the water phase of a (o/w/o) multiple emulsion, contains a further active ingredient, preferably a fragrance/malodour combater, or the like. The ingredient in the third phase will not substantially mix with the active ingredients in the other two phases, which will of course themselves not mix in the stable multiple emulsion system but will mix post-trigger. Nevertheless, the ingredient in the third phase can add to the functioning of the composition by being a moiety that promotes or assists the cleaning process, or improves the properties of the composition in some other way, for example, by improving the fragrance of the composition, or the like.

Alternatively, both active ingredients could be enzymes and in this manner it is possible to keep apart, at least until the trigger mechanism is activated, two enzymes which would react with each other in normal circumstances. It is quite common that two enzymes in a cleaning composition not of the stabilised multiple emulsion type would react with each other in a manner detrimental to the efficiency of the overall composition as a cleaning composition. Therefore, a problem is how to keep such enzymes apart in a convenient cleaning composition. A possible solution is to use the stabilised multiple emulsion systems as herein described. Hence, cleaning compositions which would normally have a very short shelf-life, can be kept indefinitely, or at least until the trigger mechanism is activated, by using stabilised multiple emulsion systems. Hence, each enzyme will function as a cleaning agent in the stabilised multiple emulsion, without being adversely affected by the presence of the other enzyme, held in a separate phase. After trigger, the enzymes will be brought into contact and cleaning will continue for a time, as and until the two enzymes react in a manner detrimental to the cleaning efficiency. Nevertheless, without the initial stabilised multiple emulsion system, this detrimental reaction would occur as soon as the composition were made, i.e. the shelf-life of the composition is much improved via use of a stabilised multiple emulsion system.

Examples of enzymes which would normally react and therefore could not be kept for any period of time in a conventional cleaning composition are protease (on the one hand) and lipase or amylase (on the other hand). Were protease to be retained in one of the effectively separated aqueous phases of a stabilised (w/o/w) multiple emulsion system of the present invention, and lipase or amylase to be retained in the other, the enzymes would be kept apart until the trigger is applied.

In a yet further embodiment, both active ingredients can be fragrances/malodour combaters, preferably different fragrances/malodour combaters, such that after the trigger mechanism and therefore mixing of the previously-separated phases, an intensification or change in the fragrance denotes to the user that the phases have mixed.

Alternatively, one active ingredient could be another moiety which, when mixed with the fragrance/malodour combater being the other active ingredient, causes a detectable fragrance change which will alert the user that the phases have mixed. In this case, the other active ingredient can be a reducing or oxidising moiety, preferably an oxidising moiety. Typical fragrances/malodour combaters include ODEL® and ELIM-O®.

In a yet further embodiment, one active ingredient can be an acidic moiety, or an acid stabilised moiety, whilst the other active ingredient is an alkaline moiety, or an alkaline stabilised moiety. When the trigger mechanism is activated, the respective moieties will mix, an acid/alkali reaction will take place, with an accompanying change in pH distribution in the environment of the cleaning composition. Such pH changes can be utilised in cleaning compositions comprising a dual cleaning functionality, or sequential cleaning functionality, for instance, one cleaning agent being active in acidic conditions, the other in alkaline conditions. Similarly, the alkaline moiety can be a bicarbonate moiety, which will effervesce when it comes into contact with the acidic moiety, clearly showing when the phases have been mixed. Moreover, heat production may accompany the acid/alkali reaction, with the benefits to cleaning as noted hereinbefore.

It is generally found to be advantageous to have a cleaning composition which is initially alkaline, to effect a first stage of cleaning of a substrate/surface, but which does not remain so, in order to prevent damage to the substrate/surface, and to effect a second, acidic, stage of cleaning of the substrate. Hence, this embodiment could comprise an alkaline moiety being, or containing, a cleaning agent as the first active ingredient, and an acidic moiety being, or containing, a cleaning agent as the second active ingredient, such that pre-trigger the cleaning composition is overall alkaline, and after-trigger, the cleaning composition is overall acidic in nature. Equally suitably, the composition may pre-trigger be overall acidic, and post-trigger, overall alkaline in nature.

It is therefore possible to produce "2-in-1" cleaning compositions using the multiple emulsion systems described herein, wherein, for example, the composition will clean soap scum and grease at alkaline pH and remove or prevent limescale at acidic pH.

Suitably, the alkaline moiety can be selected from the group comprising inorganic compounds, preferably alkali metal compounds, especially alkali metal carbonates, bicarbonates and hydroxides, and alkali metal peroxy compounds, preferably percarbonates and perborates. Especially preferred are sodium carbonate, sodium bicarbonate, sodium hydroxide, potassium hydroxide, calcium hydroxide, sodium percarbonate and sodium perborate. Sodium hydroxide is most especially preferred.

Suitably, the acidic moiety can be selected from the group comprising organic and inorganic acids or precursor compounds thereto. Particularly suitable acids include organic acids, for example citric acid, formic acid, lactic acid, succinic acid and acetic acid, and inorganic acids, for example hydrochloric acid and sulphamic acid. Sulphamic acid is especially preferred.

Typically, an acid precursor may be an acid halide, acid anhydride or aldehyde.

In a yet further embodiment, one active ingredient can be an acid, for example, acidic moieties as hereinbefore defined, preferably hydrochloric acid or sulphamic acid, whilst the other active ingredient is a chlorite, for example sodium chlorite, $NaClO_2$. Such chlorite molecules are stable in alkaline conditions. However, when the trigger mechanism is activated, the sodium chlorite will encounter acidic conditions, and both sodium hydroxide and chlorine dioxide will form. The former is an alkaline agent whilst the latter is a bleaching agent. In addition, the latter is also an anti-bacterial/anti-fungal agent. Both are advantageous in cleaning compositions.

In a similar embodiment, one active ingredient can be a peroxide moiety, the other active ingredient an alkaline moiety. It is generally the case that peroxide moieties are stable in acidic conditions, but not in alkaline conditions. In the latter, the peroxide moieties will give off active oxygen molecules, these being useful in cleaning compositions. Hence, multiple emulsion systems containing a peroxide moiety as a first active ingredient and an alkaline moiety as a second active ingredient will provide a preferred embodiment in that subsequent to the trigger, the peroxide moiety will encounter alkaline conditions, and hence, active oxygen molecules will form.

In a yet further embodiment, one active ingredient is a peroxide moiety, the other a hypochlorite molecule. Once the trigger mechanism is activated, the two moieties can mix, leading to the formation of a mousse in the presence is of a nonionic, cationic, anionic or zwitterionic surfactant, which can be used advantageously in cleaning compositions.

In a still further embodiment, one active ingredient is a monomer. The other active ingredient can then be such that a polymer is formed when the phases are mixed, i.e. upon activation of the trigger. For instance, the other active ingredient could be a catalyst. Alternatively, the other active ingredient could be a cross-linking agent, such that the monomer becomes cross-linked after the active ingredients are mixed and thus the cleaning composition will thicken in use, preferably creating a film in situ. The film will modify and/or coat the surface to which the composition is applied, thus forming a barrier. Hence, this particular embodiment would be useful in a method of preventative cleaning. Alternatively, mixing of the actives could thin the external or outer phase. In this instance, the internal or inner phase will contain a thinning agent which will act by either physical or chemical means to thin the external phase and hence, the composition overall.

Typical cross-linking agents will include agents comprising divalent ions, e.g. calcium ions, which can bridge, for example, two carboxylate groups. Alternatively, the cross-linking agents may comprise moieties which cause cross-linking either via a change in pH, or wherein the cross-linking is initiated by radicals, UV light, chemical reaction and the like.

In a yet further embodiment, one active ingredient can be a foam-forming moiety, the other a de-foaming moiety. In use as a cleaning composition, a foam will form, and will then be made to collapse when the foam-forming and de-foaming moieties mix after trigger.

In a yet further embodiment, the active ingredients can be moieties that together react to form a surfactant, i.e. the active ingredients are surfactant precursors. Thus, after activation of the trigger mechanism, the phases containing the active ingredients will mix, as will the active ingredients contained therein, and hence a surfactant will form. Surfactants are useful in cleaning compositions, and hence the present embodiment possesses advantages in the cleaning composition field. Typical examples are soap precursors, for instance an alkali hydroxide, typically sodium hydroxide, and an organic acid, preferably one with a long tail.

In a final embodiment, the active ingredients are such that when the trigger mechanism is released, the phases will mix and a reaction takes place which leads to the generation of light, either by chemiluminescence, fluorescence, phosphorescence, or some other light-generating reaction. Thus, if other active ingredients are present in the phases, which, when mixed, cause the cleaning compositions to function as such, then the onset of a cleaning action when the phases mix will be confirmed to the user of the composition by the chemiluminescence, fluorescence, phosphorescence or light-generating effects set out above.

Details of particular active ingredients useful in this embodiment are found in Applied Fluorescence in Chemistry, Biology and Medicine, eds. W. Rettig, B. Strehmel, S. Schrader, H. Seifert (1998), Springerverlag Berlin, ISBN 354-0644-512, which is herein incorporated by reference.

Although multiple emulsions of the (w/o/w) type are preferred in the embodiments of the present invention, the use of (o/w/o) type emulsions is also possible. Specific examples of useful (o/w/o) emulsions contain oil-soluble peroxide moieties, oil-soluble dyes, oil-soluble monomers/activators, and/or oil-soluble fragrances/malodour combaters, in the oily phases. Preferably, bleach could be present in the third phase, the water-based phase.

In any or all of the specific embodiments noted above, it is preferable that the phases of the multiple emulsion systems, more preferably the phases of the multiple emulsion systems that mix after the external or internal trigger mechanism, further comprise compositions conventionally used in cleaning compositions and the like.

Hence, the active or antagonistic ingredients brought together by the trigger can themselves function as cleaning agents, either before or after the trigger, or at both times, or alternatively, may simply indicate to the user that mixing of the phases has taken place and thus that the cleaning composition is now in the mode where the multiple emulsion system has effectively collapsed and the previously separate phases have mixed, with the further compositions providing some or all of the cleaning action of the cleaning composition.

In addition, the particulate moiety used to stabilise the multiple emulsion system, preferably functionalised silica, may itself exhibit a beneficial cleaning effect, for example by the emulsification or roll-up of soil from a soiled surface.

The cleaning compositions hereinbefore described can further comprise other components in any of the phases of the multiple emulsion systems compatible with such systems and which furthermore, may have a beneficial effect on the compositions in cleaning methods. For instance, the compositions may further comprise at least one of a dessicant, a disintegrant, and one or more surfactants. Such surfactants are well-known in the art and may be anionic, cationic, non-ionic or amphoteric (zwitterionic) surface active agents. Of course, such further components should be compatible with the multiple emulsion systems described herein.

The compositions of the present invention may include therein one or more organic solvents, such as lower alkyl alcohols, lower alkyl diols or glycol ethers. Such compounds may function as cleaning agents in the compounds of the present invention, and may be especially useful in glass cleaners due to their lack of tendency to smear.

Cleaning compositions of the present invention may be used, for example, for textile and/or fabric materials, including carpets and clothes.

A preferred cleaning composition of the present invention is a hard surface cleaner (HSC) for cleaning ceramics, glass, stone, plastics, marble, metal, and wood; and particularly for cleaning bathroom and kitchen hard surfaces, for example, sinks, bowls, toilets, panels, tiles and worktops, dishes (china, porcelain, etc.), plastics, and the like.

A preferred cleaning composition is adapted for cleaning lavatory bowls and for this purpose the composition may be packaged in an ITB (In Toilet Bowl) or ITC (In Toilet Cistern) device, preferably in a holder which hangs from the rim of the bowl or cistern.

Equally preferred, the compositions of the present invention can be used as fabric surface cleaners.

Another preferred cleaning composition is adapted for cleaning dentures (normally of polyacrylic material) and is therefore effective in removing staining and/or plaque.

Cleaning compositions of the invention may be used as dishwasher cleaning compositions and may also be used in washing some textile materials.

Preferably, the cleaning composition is antimicrobial. Preferably, the antimicrobial effect is generated when the phases of the multiple emulsion system mix after the trigger. Preferably, an antimicrobial chemical is generated in situ or released by dissolution or dispersion. The antimicrobial chemical may, for example, comprise an iodate, bromate, thiocyanate, chlorate or peroxy compound, or chlorine dioxide (generated from a chlorite), chlorine, bromine or iodine.

According to a second aspect of the present invention, there is provided the use of a multiple emulsion system as a cleaning composition, wherein said emulsion system comprises at least two active ingredients separated in the emulsion system by an oily or aqueous phase, and wherein said emulsion system is effectively stabilised. Preferably, when said multiple emulsion system is in use as a cleaning composition, said active ingredients previously held separate in the system are brought into contact with each other.

Thus, according to this second aspect, the use of multiple emulsion systems as hereinbefore described as cleaning compositions is disclosed.

According to a third aspect of the present invention, there is provided a multiple emulsion system comprising at least two active ingredients separated in the system by an oily or aqueous phase for use as a cleaning composition, and wherein said system is effectively stabilised. Preferably, when said multiple emulsion system is in use as a cleaning composition, said active ingredients previously held separate in the system are brought into contact with each other.

Thus, according to this third aspect, multiple emulsion systems as hereinbefore described are disclosed for use as cleaning compositions.

According to a fourth aspect of the present invention, there is provided a method of cleaning a surface, preferably a hard surface, the method comprising the use of a cleaning composition comprising a multiple emulsion system, wherein said emulsion system comprises at least two active ingredients separated in the emulsion system by an oily or aqueous phase, and wherein said emulsion system is effectively stabilised. Preferably, when said multiple emulsion system is in use as a cleaning composition, said active ingredients previously held separate in the system are brought into contact with each other.

Thus, according to this fourth aspect, a method of cleaning a surface is disclosed, using multiple emulsion systems as hereinbefore described.

Suitably, the surface to be cleaned is a hard or fabric surface, preferably, in the case of a hard surface, the surface to be cleaned is made of ceramics, glass, stone, plastics, marble, metal, or wood.

It will be appreciated that the present invention offers many benefits to the consumer. In particular, the stabilised multiple emulsion systems enable cleaning compositions to comprise ingredients that under normal conditions would react and/or combine with each other before such reaction and/or combination was required. The ingredients are effectively separated in the multiple emulsion cleaning compositions disclosed herein as and until a trigger is deployed, from which point the ingredients will combine and/or react, thus providing the particular desired effect of the embodiment. This effect can either be part of the cleaning process itself, or can be indicative that the cleaning process is at work.

The second, third and fourth aspects of the invention may incorporate any one or more of the preferred features or embodiments of the first aspect of the invention except of course where such features or embodiments are mutually exclusive or incompatible.

In order that the invention be better understood, embodiments of it will now be described by way of the following non-limiting examples and the accompanying figures wherein FIGS. 1-3 show the following:

Figure 1:
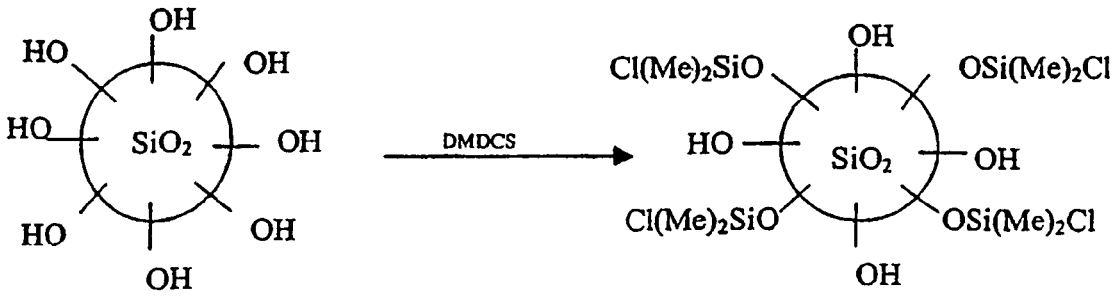
FIG. 1 shows the schematic reaction of fumed silica with dichlorodimethylsilane to form silica with certain of the silanol groups replaced by $Cl(Me)_2SiO$— groups.
Figure 2:
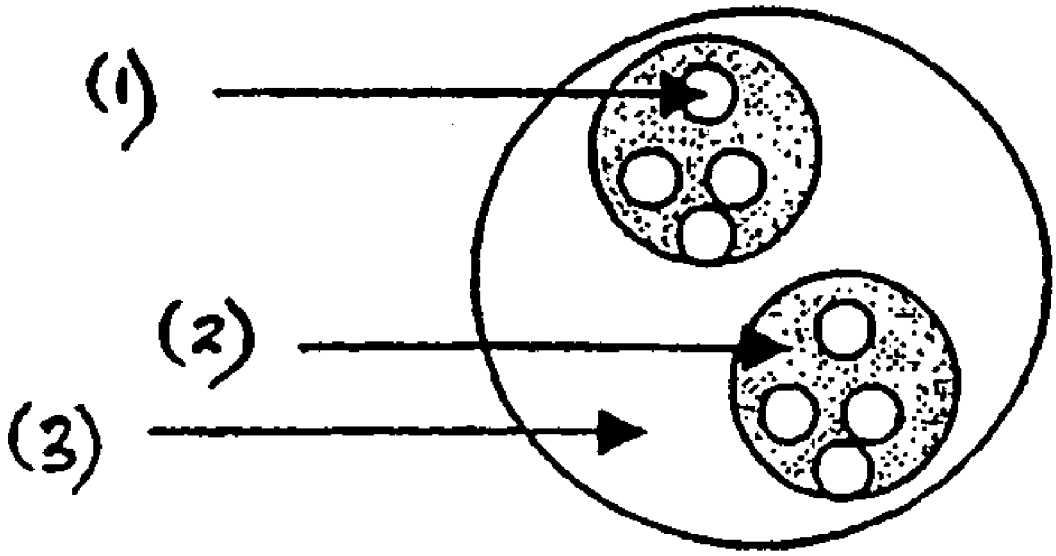
FIG. 2 shows the different regions in a stabilised (w/o/w) multiple emulsion system; and, FIG. 3 shows the transport mechanism under hypo-osmotic conditions for a (w/o/w) multiple emulsion system.
Figure 3:
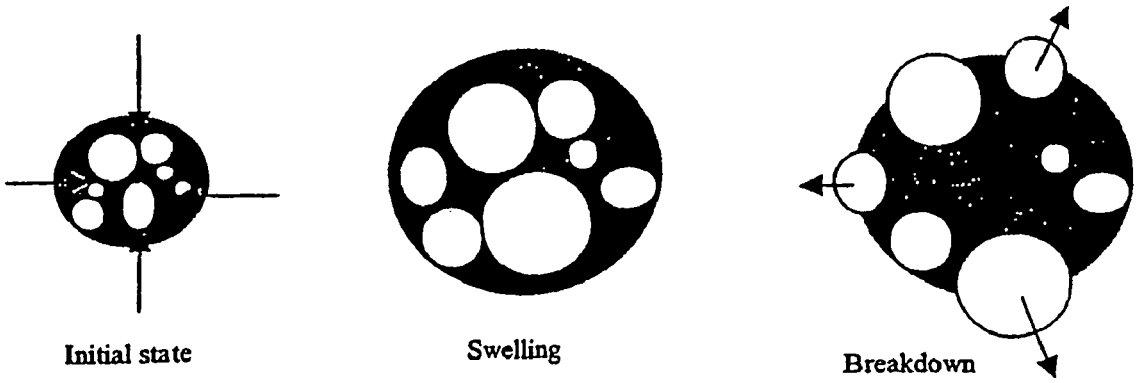

There now follows a detailed description of illustrative but non-limiting examples according to different aspects and embodiments of the invention.

EXAMPLE 1

Use of Functionalised Silica as a Multiple Emulsion Stabiliser

The following provides a method of preparation for a (w/o/w) emulsion.

First, a simple (w/o) emulsion is formed. The aqueous phase of the simple (w/o) emulsion will form the internal aqueous phase of the (w/o/w) multiple emulsion system. 1% by weight of hydrophobic silica particles (with a % SiOH content of 50%) of a mean diameter of 20 nm were dispersed in 10 ml of oil using an ultrasonic probe set at 20 kHz for 2 minutes. Then, 2.5 ml of the aqueous phase was added followed by homogenisation with an ultra-turrax at 13000 rpm for a further 2 minutes.

In a second stage, the simple (w/o) emulsion is converted into a final (w/o/w) multiple emulsion. In this stage, the aqueous phase will form the continuous phase in the final (w/o/w) emulsion. 2% by weight of hydrophilic silica particles (with a % SiOH content of 76%) were dispersed in 10 ml of an aqueous phase using an ultrasonic probe set at 20 kHz for 2 minutes. Then, 2.5 ml of the simple (w/o) emulsion from the first stage was added followed by homogenisation with an ultra-turrax at 11000 rpm for 5 seconds.

Suitable active ingredients are incorporated into the (w/o/w) emulsion by ensuring their presence in the aqueous phases of the above method.

EXAMPLE 2

Stability of (w/o/w) Multiple Emulsion Systems

A (w/o/w) multiple emulsion was formed as per the details given in Example 1 above. Each aqueous phase of the (w/o/w) emulsion contained a water soluble dye; tartrazine (yellow) and FD&C blue No. 1 (blue). The oil phase comprised hexadecane oil. Any breakdown of the (w/o/w) emulsion would cause the two aqueous phases to mix, the blue and yellow dyes to be brought into contact, and a green colour to result. In the present case, where the (w/o/w) emulsion was formed as per Example 1, the (w/o/w) emulsion was found to be stable over a period of at least 9 months, i.e. no green colouration was observed.

When the homogenisation step of the second stage of the method of Example 1 above was replaced by simple hand shaking, then a creaming effect was seen over the 9 month period, but not coalescence. Hence, some mixing of the two aqueous phases was seen, although essentially, a stable w/o/w emulsion system was still formed.

Of course, in accordance with the present invention each aqueous phase contains a different active cleaning ingredient.

The invention claimed is:

1. A method of cleaning a hard surface, the method comprising the steps of:

providing a hard surface cleaning composition comprising a multiple emulsion system, wherein said multiple emulsion system is of the oil-in-water-in-oil type or the water-in-oil-in-water type and comprises at least two mutually incompatible or antagonistic active ingredients separated in said system by an oily or aqueous phase, then the at least two active ingredients previously held in separate phases of said system are brought into contact with each other and react to form different or enhanced active ingredients for use in the hard surface cleaning composition, wherein effective stabilization of said emulsion system is by particulate moieties comprising a hydrophobic particulate moiety and a hydrophilic particulate moiety; and applying the hard surface cleaning composition to a hard surface selected from the group consisting of a ceramic, a glass, a stone, a plastic, a marble, a metal, and a wood.

2. A method according claim 1, wherein the hard surface is a bathroom hard surface or a kitchen hard surface.

3. A method according claim 2, wherein the bathroom hard surface or the kitchen hard surface is selected from the group consisting of a sink, a bowl, a toilet, a panel, a tile, a worktop and a dish.

4. A method according to claim 1, wherein the hydrophobic particulate moiety of the hard surface cleaning composition comprises hydrophobic silica particles.

5. A method according to claim 4, wherein in the hard surface cleaning composition the a percentage of silanol groups/groups in total for the hydrophobic silica particles is 65% or less.

6. A method according to claim 1, wherein the hydrophilic particulate moiety of the hard surface cleaning composition comprises hydrophilic silica particles.

7. A method according to claim 6, wherein the percentage of silanol groups/groups in total for the hydrophilic silica particles is 65% or more.

8. A method according to claim 1, wherein in the hard surface cleaning composition said multiple emulsion system is of the water-in-oil-in-water type.

9. A method according to claim 1, wherein in the hard surface cleaning composition said active ingredients are brought together by a trigger.

10. A method according to claim 1, wherein in the hard surface cleaning composition said particulate moieties exhibit different degrees of hydrophobicity.

11. A method according to claim 1, wherein in the hard surface cleaning composition said particulate moieties are functionalized silica.

12. A method according to claim 1, wherein in the hard surface cleaning composition said particulate moieties are less than 30 nm in mean diameter.

13. A method according to claim 1, wherein in the hard surface cleaning composition said active ingredients are moieties which have a positive effect on the performance of the system as a cleaning composition.

14. A method according to claim 1 wherein in the hard surface cleaning composition said active ingredients are selected from the group consisting of: color molecules/dyes, bleaches, bleach activators, oxidizing agents, reducing agents, enzymes, catalysts, peroxides, acidic moieties, acid-stabilized moieties, alkaline moieties, alkaline-stabilised moieties, chlorites, hypochlorites, monomers, cross-linking agents, foam-forming moieties, de-foaming moieties, surfactants, surfactant precursors, and fragrances/malodour combaters.

15. A method according to claim 1, wherein in the hard surface cleaning composition the oily phase of a water-in-oil-in-water emulsion system or the aqueous phase of a oil-in-water-in-oil emulsion system comprises an active ingredient selected from the group consisting of: colour molecules/dyes, bleaches, bleach activators, oxidising agents, reducing agents, enzymes, catalysts, peroxides, acidic moieties, acid-stabilised moieties, alkaline moieties, alkaline-stabilised moieties, chlorites, hypochlorites, monomers, cross-linking agents, foam-forming moieties, de-foaming moieties, surfactants, surfactant precursors, and fragrances/malodour combaters.

16. A method according to claim 1, wherein the hard surface cleaning composition is adapted for use in non-cosmetic, household cleaning applications.

17. A method according to claim 1, wherein the hard surface cleaning composition is an antimicrobial composition.

* * * * *